US009109585B2

(12) United States Patent
Mueller

(10) Patent No.: US 9,109,585 B2
(45) Date of Patent: Aug. 18, 2015

(54) PUMP

(75) Inventor: Markus Mueller, Muennerstadt (DE)

(73) Assignee: YASA MOTORS POLAND SP. ZO.O., Mielec (PL)

( * ) Notice: Subject to any disclaimer, the term of this patent is extended or adjusted under 35 U.S.C. 154(b) by 580 days.

(21) Appl. No.: 13/576,774

(22) PCT Filed: Jan. 24, 2011

(86) PCT No.: PCT/EP2011/000265
§ 371 (c)(1),
(2), (4) Date: Sep. 17, 2012

(87) PCT Pub. No.: WO2011/095287
PCT Pub. Date: Aug. 11, 2011

(65) Prior Publication Data

US 2012/0328459 A1 Dec. 27, 2012

(30) Foreign Application Priority Data

Feb. 4, 2010 (DE) ..... 10 2010 006 929

(51) Int. Cl.

| | |
|---|---|
| ***F04B 35/00*** | (2006.01) |
| ***F04B 19/00*** | (2006.01) |
| ***F04B 19/02*** | (2006.01) |
| ***F04B 1/113*** | (2006.01) |
| ***F04B 17/00*** | (2006.01) |

(52) U.S. Cl.
CPC ..... *F04B 19/003* (2013.01); *F04B 1/1133* (2013.01); *F04B 17/00* (2013.01); *F04B 19/02* (2013.01); *F04B 19/025* (2013.01)

(58) Field of Classification Search
CPC ..... F04B 17/00; F04B 19/003; F04B 19/025; F04B 19/02; F04B 1/1133
USPC ..... 417/462; 91/493
See application file for complete search history.

(56) References Cited

U.S. PATENT DOCUMENTS

| | | | | |
|---|---|---|---|---|
| 1,307,210 A | | 6/1919 | Newcomb | |
| 1,910,876 A | * | 5/1933 | Appel | 74/22 R |
| 3,056,356 A | * | 10/1962 | Piper | 417/462 |

(Continued)

FOREIGN PATENT DOCUMENTS

| | | |
|---|---|---|
| DE | 640936 C | 1/1937 |
| DE | 873207 C | 4/1953 |

(Continued)

*Primary Examiner* — Peter J Bertheaud
*Assistant Examiner* — Dominick L Plakkoottam
(74) *Attorney, Agent, or Firm* — Lucas & Mercanti, LLP

(57) ABSTRACT

The invention relates to a pump (1) for conveying of a fluid from an intake region (2) to an outlet region (3) which has a housing (4) and at least one rotor (6) which is arranged rotatable around an axis of rotation (5) and which can be driven by a driving element. To obtain a high degree of efficiency the pump according to the invention is characterized in that the rotor (6) has a bore (7), that a piston element (8) is arranged in the bore which can move along the longitudinal axis (L) of the bore and that a plurality of magnets (9, 9', 9", . . . ) or a ring magnet is arranged stationary in the housing (4), wherein the magnets or the ring magnet exert a magnetic attractive force on the piston element (8), wherein the magnets (9, 9', 9", . . . ) or a ring magnet are arranged in such a manner in the housing (4) that the piston element (8) carries out an oscillating movement (O) in the bore (7) during rotation of the rotor (6) around the axis (5) due to the magnetic attractive force.

12 Claims, 5 Drawing Sheets

(56) References Cited

U.S. PATENT DOCUMENTS

Figure 1:
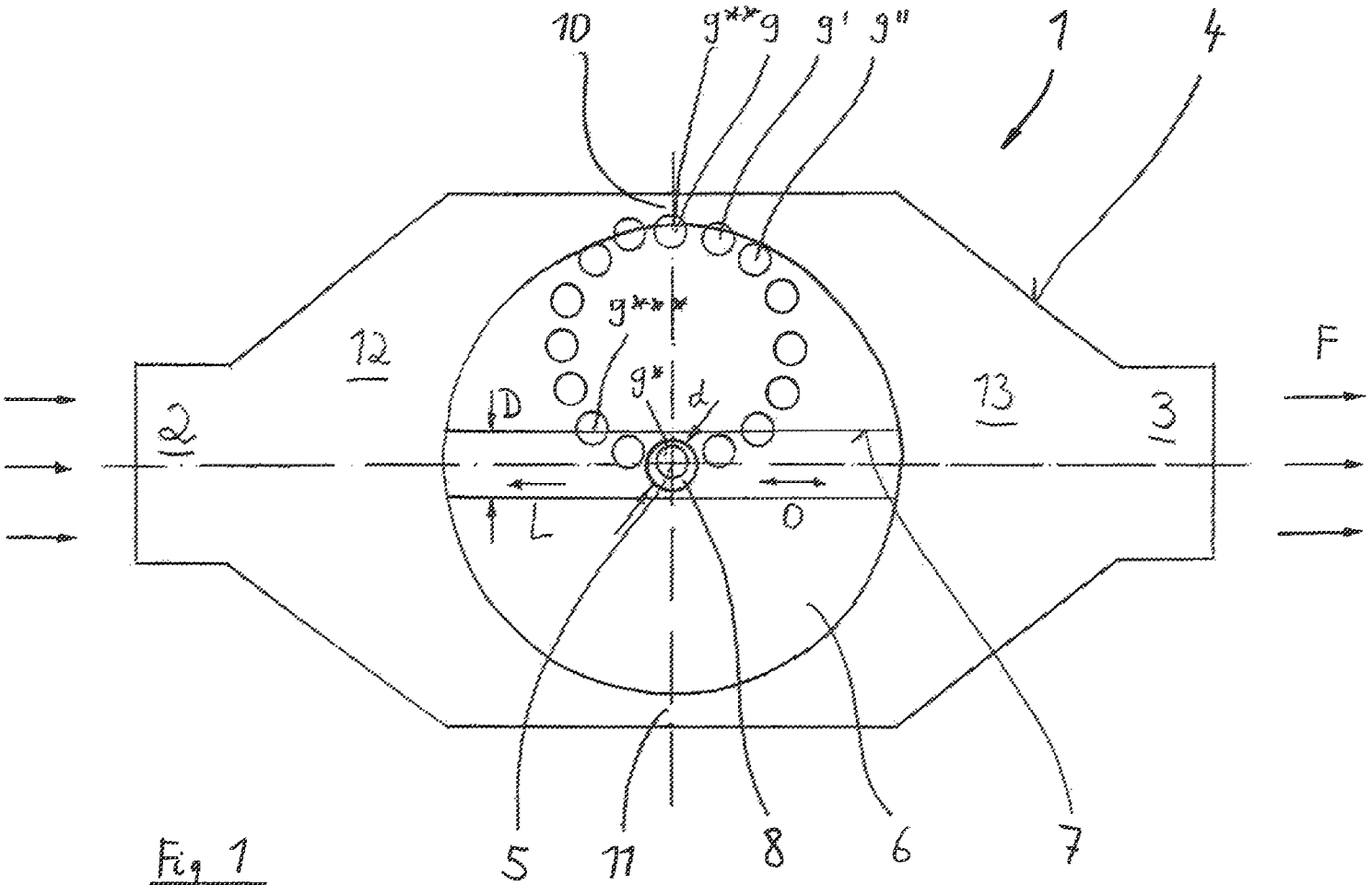

| | | | | |
|---|---|---|---|---|
| 4,513,575 | A * | 4/1985 | Dibrell | 62/86 |
| 6,576,010 | B2 * | 6/2003 | Ulert et al. | 623/3.1 |
| 8,011,903 | B2 * | 9/2011 | Pollack | 417/420 |
| 2008/0008609 | A1 * | 1/2008 | Pate et al. | 417/415 |
| 2008/0175721 | A1 * | 7/2008 | Yang | 417/53 |

FOREIGN PATENT DOCUMENTS

| | | | |
|---|---|---|---|
| DE | 1218882 | B | 6/1966 |
| GB | 143 688 | A | 6/1920 |
| GB | 147471 | A | 11/1921 |
| WO | 2007/109836 | A1 | 10/2007 |

* cited by examiner

PUMP

CROSS-REFERENCE TO RELATED APPLICATIONS

This application is a 371 of PCT/EP2011/000265 filed Jan. 24, 2011, which in turn claims the priority of DE 10 2010 006 929,9 filed Feb. 4, 2010, the priority of both applications is hereby claimed and both applications are incorporated by reference herein.

The invention relates to a pump for conveying of a fluid from an intake region to an outlet region which has a housing and at least one rotor which is arranged rotatable around an axis of rotation and which can be driven by a driving element.

Pumps of this kind are well known in the art. They are applied for example in heating systems to pump water into the heating circuit. In most cases namely centrifugal pumps are applied for the mentioned application.

In consideration of the efficiency of energy these pumps have proved to be disadvantageous. At typical velocity and flow rate the hydraulic degree of efficiency is mostly not more than 35%. The reason therefore is the recirculation what centrifugal pumps work with to achieve the necessary building of pressure. At a low pump sizes which are typical for the application in the heating construction, the occurring leakages have a super proportional effect.

With respect to economic viewpoints it is furthermore essential to be able to produce the pump cost effective, since they are required in a very high quantity.

Thus, it is an object of the invention to further develop a pump of the generic kind in such a way that the hydraulic degree of efficiency is increased, wherein a cost efficient manufacturing possibility shall exist. Thereby the pump shall be applicable particularly, but not exclusively in the area of heating construction.

The solution of this object by the invention is characterized in that the rotor has a bore, that a piston element is arranged in the bore which can move along the longitudinal axis of the bore and that a plurality of magnets or a ring magnet is arranged stationary in the housing, wherein the magnets or the ring magnet exert a magnetic attractive force on the piston element, wherein the magnets or a ring magnet are arranged in such a manner in the housing that the piston element carries out an oscillating movement in the bore during rotation of the rotor around the axis due to the magnetic attractive force.

Accordingly the magnets move the piston element during rotation of the rotor in the longitudinal direction of the bore; this oscillating movement is used for conveying of the fluid and to put it under pressure.

Preferably, the piston element is a ball. Preferably, the piston element is a magnet or it comprises at least a magnet.

Thereby, the piston element (i.e. preferably the ball) is preferably tolerated relatively to the bore in such a manner that fluid which is in the bore is displaced out of the bore and is sucked in the bore respectively during the translational movement of the piston element in the bore.

Preferably, the bore in the rotor is arranged perpendicular to the axis of rotation of the rotor.

Preferably, a seal is arranged or constructed between the housing and the rotor at each of two opposed locations of the rotor. The seal is preferably established by a narrow point between the rotor and the housing. A flow channel for intake fluid can be established between the seals and the intake region. Correspondingly, a flow channel for outlet fluid can be established between the seals and the outlet region.

The magnets, which control the movement of the piston element in the bore, are preferably arranged along a closed curve path within the housing; preferably the curve path is a circular path. Alternatively to a plurality of discrete magnets a ring element can be employed.

The magnets and the ring magnet respectively are preferably permanent magnets.

The diameter of the bore is preferably bigger than the diameter of the piston element, especially of the ball, by an amount between 0.05 mm and 0.3 mm, particularly between 0.1 mm and 0.2 mm.

The inner surface of the bore is specifically preferred provided with a layer of hard material to improve the ware resistance of the surface of the bore.

Also, more bores can be arranged in the rotor, especially displaced over the circumference, in which respective piston elements are arranged.

The proposed conception of the pump has its result that a much higher hydraulic degree of efficiency can be achieved, than it is possible with centrifugal pumps. By the proposed principle of displacement a degree of efficiency can be achieved up to 80%.

The bodywork which is relatively easy allows furthermore a cost efficient production so that also high lots of pumps can be produced efficiently.

Figure 2:
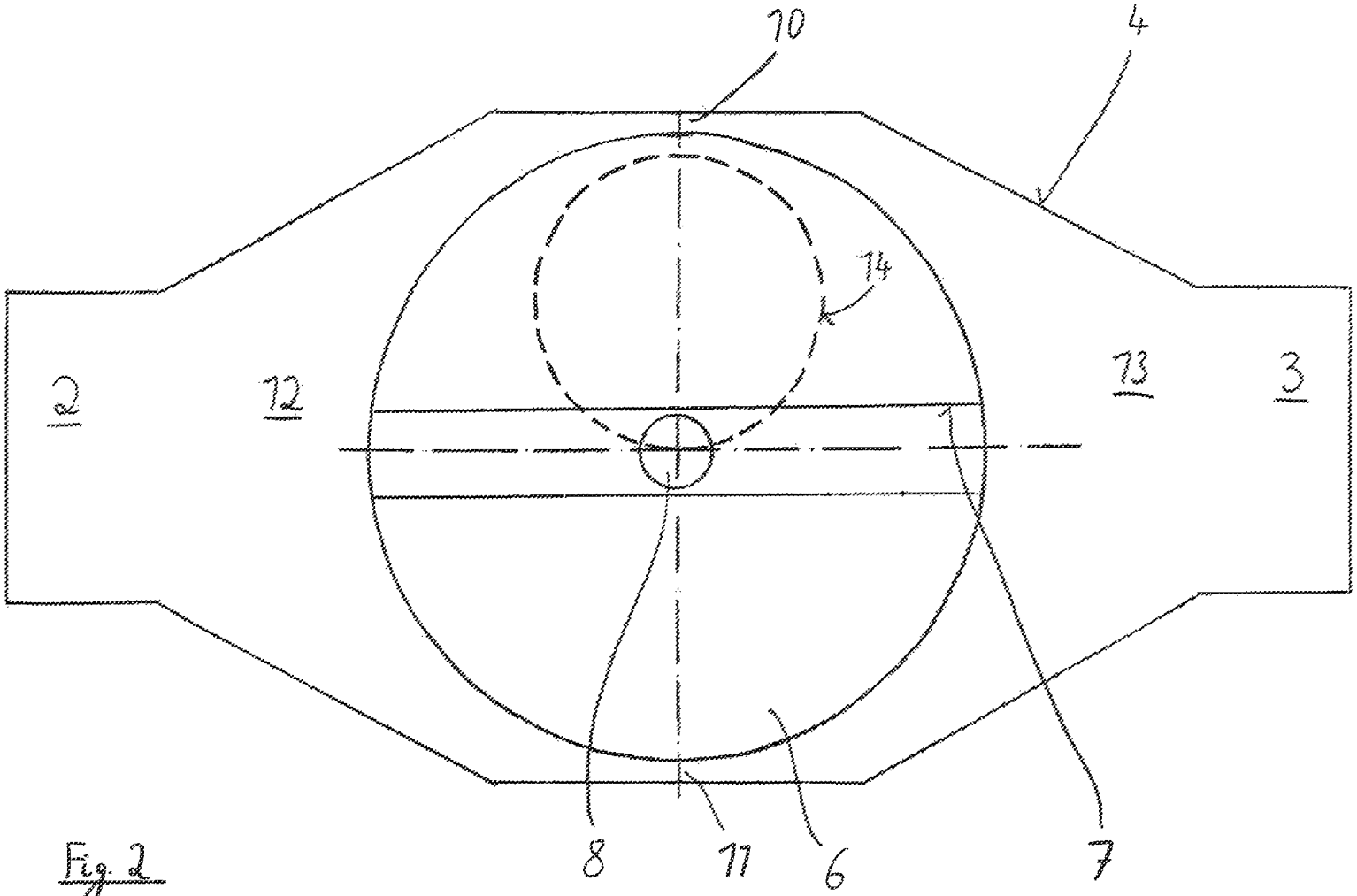
Figure 3:
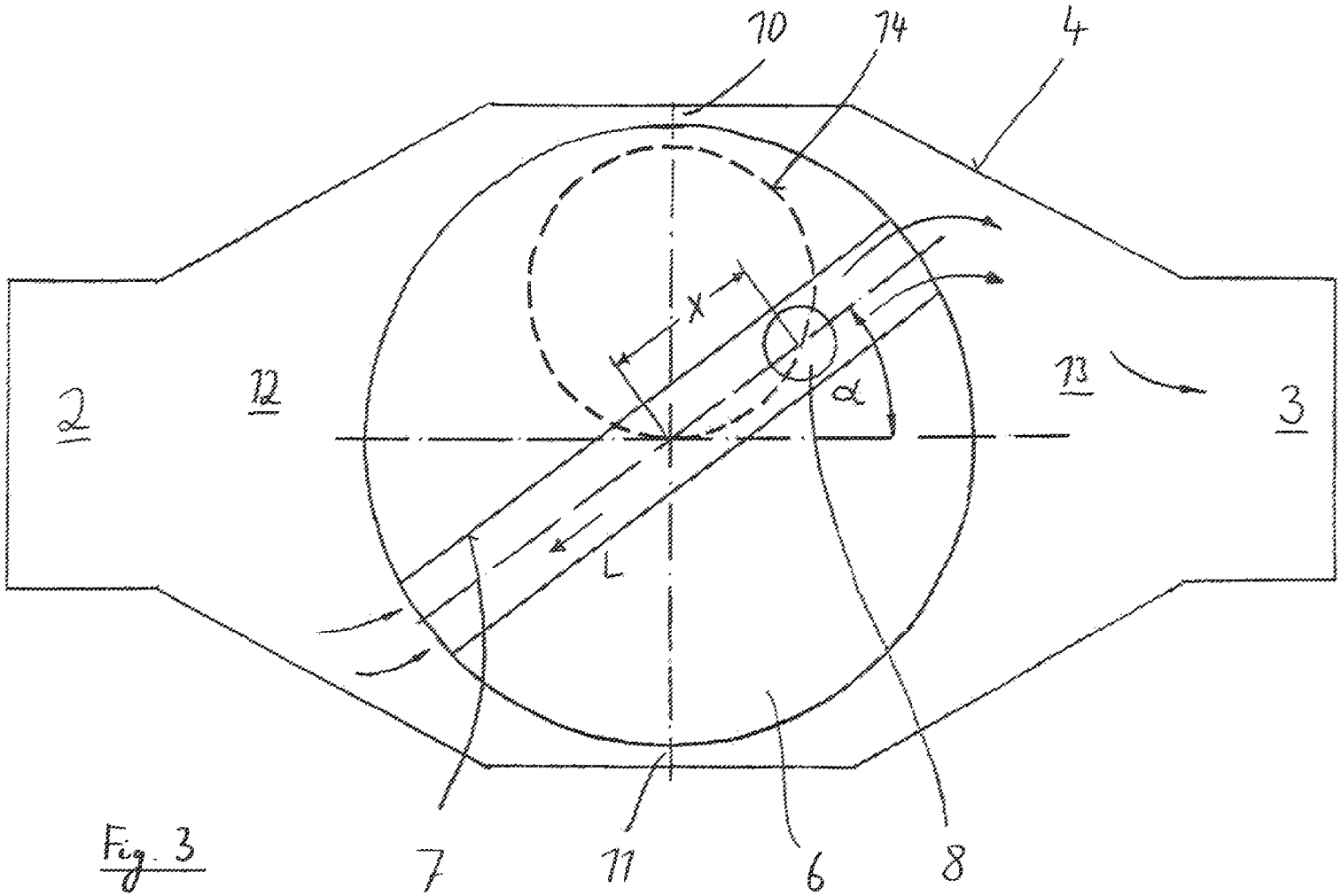
Figure 4:
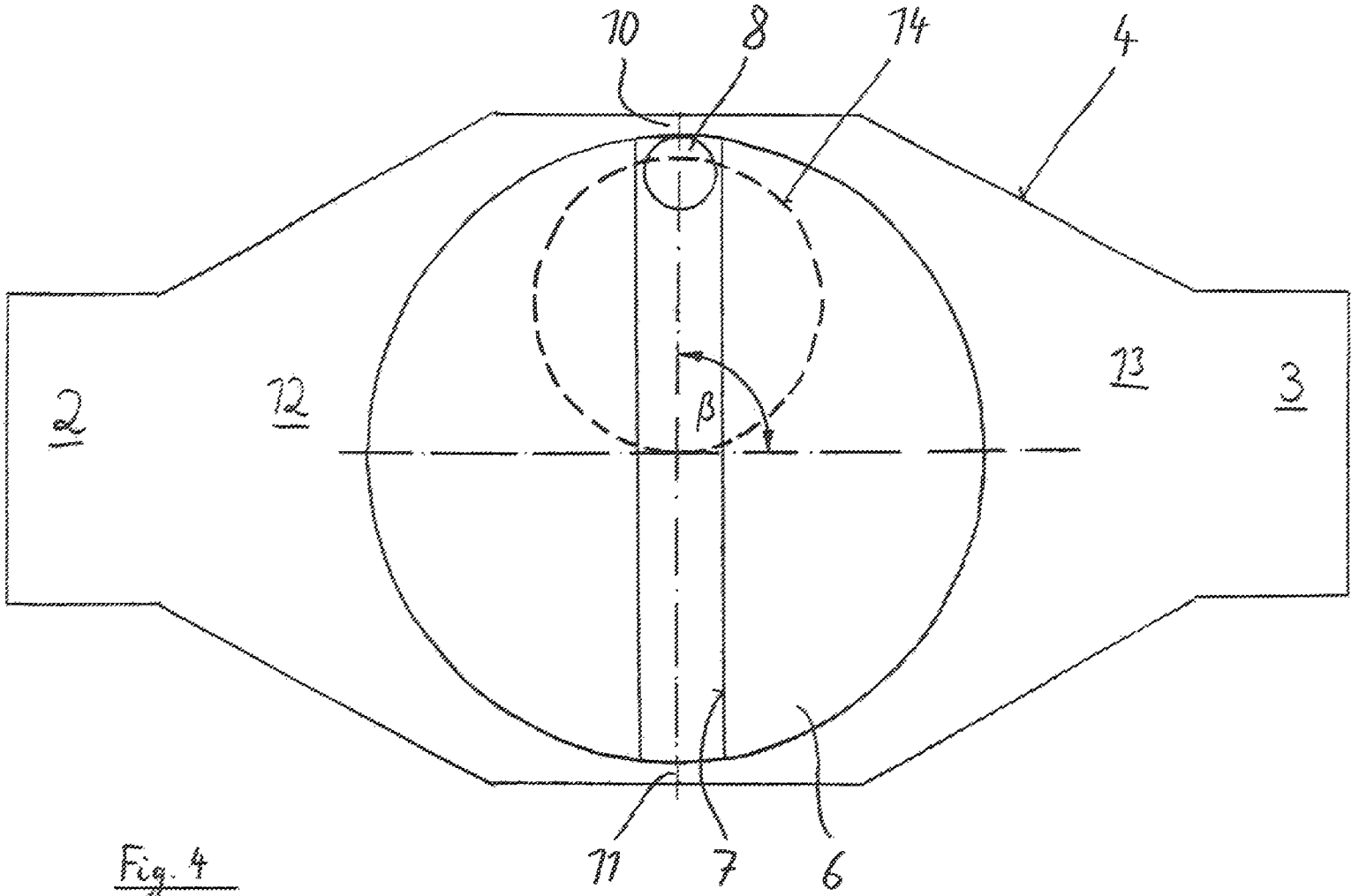
Figure 5:
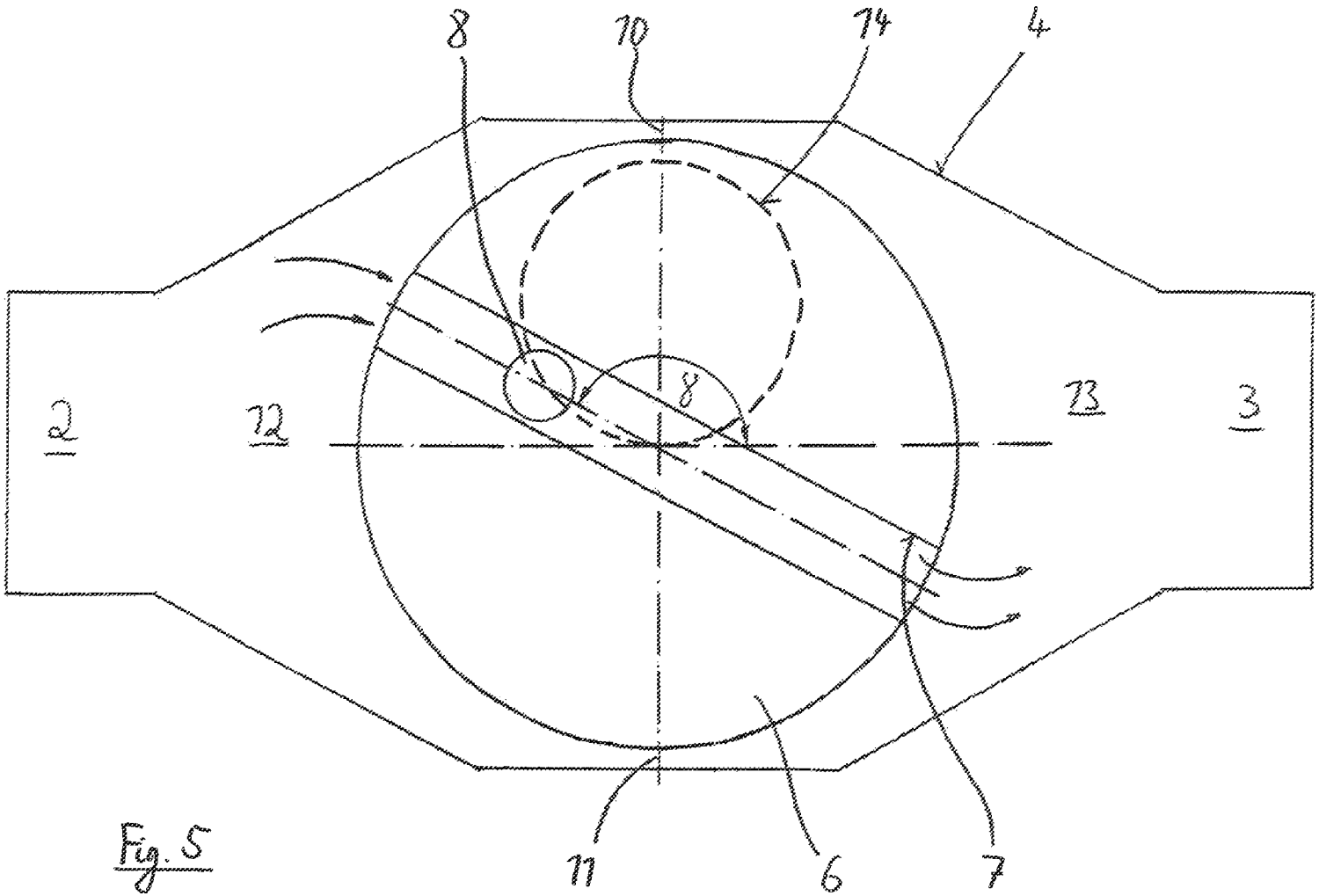

In the drawings an embodiment of the invention is shown. It shows:

FIG. 1 schematically a pump according to the invention, wherein the pump is shown in a sectional view and wherein only the important parts are demonstrated which are in relation with the invention, FIG. 2 schematically the pump according to FIG. 1 during a first step of process of the pump procedure, FIG. 3 schematically the pump according to FIG. 1 during a second step of process of the pump procedure, FIG. 4 schematically the pump according to FIG. 1 during a third step of process of the pump procedure, and FIG. 5 schematically the pump according to FIG. 1 during a fourth step of process of the pump procedure.

In FIG. 1 a pump 1 is depicted, wherein only the parts are shown which are interesting and essential here. The pump 1 works according to the principle of displacement. It has a housing 4, which extends in a direction of flow F, in which a fluid is conveyed, for example water. In doing so the housing 4 extends basically from an intake region 2 up to an outlet region. In the intake region 2 fluid is sucked into the pump 1 and is put under pressure, wherein the fluid is dispensed under increased pressure into the outlet region 3.

The central building element of the pump 1 is the rotor 6 which can rotate around an axis of rotation 5 which stands perpendicular on the plane of projection of the figures. Not demonstrated is a motor by which the rotor 6 can be rotated.

The rotor 6 has a constant bore 7 which extends itself diagonally and centrally through the rotor 6 and which stands perpendicular on the axis of rotation 5. Accordingly the bore 7 extends into the direction of the longitudinal axis of the bore L. In the bore 7 a piston element 8 is arranged in form of a ball. Within the ball 8 a permanent magnet is integrated.

Above the middle of the rotor 6 a plurality of magnets 9, 9', 9", . . . is arranged stationary in the housing 4 and indeed in such a way that the magnets 9, 9', 9", . . . are arranged along a circular path (see reference numeral 14 in the FIGS. 2 to 5). The diameter of the circle of this circular path is about the half of the diameter of the rotor 6. The magnets 9, 9', 9", . . . are—like the ball 8—performed as permanent magnets.

The magnets 9, 9', 9", . . . perform a magnetic attractive force upon the ball 8, i.e. the ball 8 is attracted from the magnets 9, 9', 9", . . . in doing so the magnet 9, 9', 9", . . . which lies closest to the ball 8 performs the commanding attractive force.

The rotor 6 has only a small distance to the wall of the housing 4 in its supreme and deepest area, which is demonstrated strongly officious in FIG. 1. Therefore a sealing gap 10 respectively 11 is on hand at the mentioned areas, so that a fluid can overflow here hardly from the intake region 2 to the outlet region 3. The marked areas with 10 and 11 are to be considered rather as sealed areas.

Hereby a flow channel 12 is created for intake fluid from the intake region 2 to the rotor 6 and a flow channel 13 for outlet fluid from the rotor 6 to the outlet region 3.

If the ball 8 moves translational back and forth within the bore, i.e. it performs an oscillating movement O, a conveying of fluid out of the bore 7 results due to the relatively small (clearance-) fit between the diameter of the ball and the diameter of the bore. In doing so fluid is sucked from the intake region 2 along the flow channel 12 in the left region of the pump 1 during rotation of the rotor 6 contrary to the clockwise direction and is conveyed into the flow channel 13 to the outlet region 3, as can be seen later. The outer diameter d of the ball is hereby preferential approx. 0.1 to 0.2 mm smaller than the diameter D of the bore 7.

In the FIGS. 2 to 5 the sequential process of the pump procedure is shown. The step of process according to FIG. 5 connects to the one according to FIG. 2 and the process repeats itself accordingly.

The overall 16 discrete magnets 9, 9', 9", . . . which are identified in FIG. 2 are not displayed in the FIGS. 2 to 5 for sake of clearness, but only the circular path 14, along which the magnets 9, 9', 9", . . . are arranged.

In a first step of process the rotor 6 stands in a basic position according to FIG. 2, i.e. the bore 7 extends in a longitudinal direction of the pump 1 from the intake region 2 to the outlet region 3. The ball 8 seals the bore 7, wherein the ball 8 is attracted from the next magnet 9* (s. FIG. 1) and is held in position due to the magnet power.

To pump fluid, the rotor will be driven in anticlockwise direction from the driving means which are not demonstrated.

In FIG. 3 for a second step of process it is to see, that in comparison to the basic position according to FIG. 2, the rotor 6 was rotated around the angle $\alpha$. The magnets 9, 9', 9", . . . thereby pulled the ball 8 along the direction of the longitudinal axis of the bore L, so that for the rotation angle $\alpha$ of the rotor 6 a translational displacement x resulted into the longitudinal axis of the bore L (s. FIG. 3). Fluid which stands within the region of the bore above the ball 8 will be pressed out into the direction of the outlet region 3, wherein fluid will be absorbed from the intake region 2 into the bore 7 through the increasing volume of bore 7 between the access lying left below of the bore 7 and the ball 8. The flow of fluid is indicated by arrows.

At further rotation the ball 8 will be pulled from the magnets 9, 9', 9", . . . further into the direction of the end of the bore—according to FIG. 4 for a third step of process at rotation of the rotor 6 adverse to the basic position according to FIG. 2 around the angle $\beta-$, until the magnet 9 (s. FIG. 1) keeps the ball 8 in position shown in FIG. 4**.

At further rotation around the angle $\gamma$ according to FIG. 5 the ball 8 is moved back in the bore 7 for the fourth state of process, since the ball 8 follows again the course of the circular path 14 and is kept in position by the appropriate magnet (in FIG. 5 perhaps from the magnet 9*, s. FIG. 1). Through the movement back of the ball 8 fluid is sucked in from the intake region 2 across the flow channel 12 into the bore opening lying above left and is delivered out of the bore opening lying right underneath across the flow channel 13 to the outlet region 3 of the bore 7 under increased pressure. The flow of fluid is indicated again by arrows.

At further rotation of the rotor 6 (up to reaching an angle $\gamma$ of 180°) the basic position is reached according to FIG. 2 and the process repeats itself according to the FIGS. 2 to 5.

The oscillation frequency of the ball 8 in the bore 7 conforms to the double rotation frequency of the rotor 6, as it is shown in the described operating method.

As no nameable flow of fluid can occur across the sealing gaps 10, 11, which are displayed officiously, a significant increasing of pressure is reached at the described pump process. The buildup of pressure can reach without any problems up to 0.5 bar, in most cases however not much more than a buildup of pressure of 0.2 to 0.3 bar is needed for the application in the field of the heating construction.

At the common operation method at maximal oscillation speeds of the ball 8 in the bore 7 are reached between 0.5 and 2 m/s.

As the ball 8 thus oscillates with a relatively high frequency within the bore 7, a low friction and operation with low wear of the ball in the bore is important. Accordingly the cylindrical inner surface of the bore 7 is provided with a layer of hard material, so that there is a high resistance of abrasion and wear resistance respectively.

At the same time a low friction coefficient between the ball and the bore surface can be reached through the suitable choice of the coating and also of the ball.

Within the ball 8 a magnet of rare earth is arranged in the embodiment. In the embodiment discrete magnets 9, 9', 9", . . . are intended. A ring magnet can be applied just as good. The employment of a ring magnet can prove to be favourable and especially the guiding quality of the piston element can be constructed more even.

LIST OF REFERENCES

1 Pump
2 Intake region
3 Outlet region
4 Housing
5 Axis of rotation
6 Rotor
7 Bore
8 Piston element (ball)
9 Magnet/ring magnet
9' Magnet
9" Magnet
10 Seal/sealing gap
11 Seal/sealing gap
12 Flow channel
13 Flow channel
14 Curve path (circular path)
F Direction of flow
L Longitudinal axis of the bore
O Oscillating movement
D Diameter of bore
d diameter of piston (of the ball)

The invention claimed is:

1. A pump for conveying of a fluid from an intake region to an outlet region which has a housing and a rotor which is arranged rotatable around an axis of rotation and which can be driven by a driving element, comprising the rotor with a bore;

a piston element is arranged in the bore which can move along the longitudinal axis (L) of the bore;

a plurality of magnets is arranged along a closed curve path stationary in the housing or a ring magnet is arranged stationary in the housing, wherein the magnets or the ring magnet exert a magnetic attractive force on the piston element;

the magnets are permanent magnets or the ring magnet is a permanent magnet;

the magnets or a ring magnet are arranged in such a manner in the housing that the piston element carries out an oscillating movement (O) in the bore during rotation of the rotor around the axis due to the magnetic attractive force.

2. The pump of claim 1, wherein the piston element is a ball.

3. The pump of claim 1, wherein the piston element is a magnet or comprises a magnet.

4. The pump of claim 3, wherein the piston element is toleranced relatively to the bore in such a manner that fluid which is in the bore is displaced out of the bore during the translational movement of the piston element in the bore.

5. The pump of claim 4, wherein the bore in the rotor is arranged perpendicular to the axis of rotation of the rotor.

6. The pump of claim 5, wherein a seal is arranged or constructed between the housing and the rotor at each of two opposed locations of the rotor.

7. The pump of claim 6, wherein the seal is established by a narrow point between the rotor and the housing.

8. The pump of claim 6, wherein a flow channel for intake fluid is established between the seals and the intake region.

9. The pump of claim 6, wherein a flow channel for outlet fluid is established between the seals and the outlet region.

10. The pump of claim 1, wherein the curve path is a circular path.

11. The pump of claim 1, wherein the diameter (D) of the bore is bigger than the diameter (d) of the piston element by an amount between 0.05 mm and 0.3 mm.

12. The pump of claim 1, wherein the inner surface of the bore is provided with a layer of hard material.

* * * * *